United States Patent [19]

Aldrich et al.

[11] Patent Number: 5,012,293

[45] Date of Patent: Apr. 30, 1991

[54] TRANSFER STATION CONTROL IN AN ELECTROPHOTOGRAPHIC REPRODUCTION DEVICE

[75] Inventors: Charles S. Aldrich; Stanley Dyer; Gregory L. Ream, all of Lexington, Ky.

[73] Assignee: International Business Machines Corporation, Armonk, N.Y.

[21] Appl. No.: 398,855

[22] Filed: Aug. 24, 1989

[51] Int. Cl.[5] ..... G03G 15/00; G03G 15/16

[52] U.S. Cl. ..... 355/274; 355/208; 355/210

[58] Field of Search ..... 355/208, 210, 219, 221, 355/271, 274; 430/126, 902

[56] References Cited

U.S. PATENT DOCUMENTS

| | | | |
|---|---|---|---|
| 3,851,230 | 11/1974 | Okamoto et al. | 361/212 |
| 4,693,593 | 9/1987 | Gerger | 355/208 |
| 4,896,192 | 1/1990 | Kinoshita | 355/274 X |

*Primary Examiner*—Joan H. Pendegrass

*Attorney, Agent, or Firm*—John W. Girvin, Jr.

[57] ABSTRACT

In an electrophotographic reproduction device, such as a copier or a printer, having a transfer station (17) whereat toner images are sequentially transferred from the surface of a moving photoconductor (10) to the adjacent surface of sheets of moving and spaced transfer material, such as paper, the transfer station is controlled in a manner to produce a substantially similar electrical effect on the photoconductor both when a sheet of transfer material resides in the transfer station intermediate the photoconductor and the transfer station, and when no sheet of transfer material is intermediate the photoconductor and the transfer station.

10 Claims, 4 Drawing Sheets

START
100
IS LEADING EDGE OF PAPER WITHIN ONE PHOTOCONDUCTOR PROCESS CYCLE OF TRANSFER PRIOR TO SHEET ARRIVAL ?
101
NO
YES
ERASE ON IN MODIFIED STATE
103
105
IS LEADING EDGE OF SHEET AT TRANSFER CORONA ?
NO
YES
107
TRANSFER ON AT REDUCED LEVEL
109
IS SHEET FULLY COVERING TRANSFER CORONA ?
NO
YES
111
TRANSFER ON AT FULL LEVEL

TRANSFER STATION CONTROL IN AN ELECTROPHOTOGRAPHIC REPRODUCTION DEVICE

FIELD OF THE INVENTION

This invention relates to the general field of photocopying, and more specifically to a method and an apparatus for controlling the transfer station of an electrophotographic reproduction device such as a printer or a copier.

BACKGROUND OF THE INVENTION

As is well known to those of skill in the art, in an electrophotographic or xerographic reproduction device an electrostatic latent image is formed on a moving photoconductor or photoreceptor that repeatedly cycles through the reproduction process as the photoconductor is reused.

The first process step of such a device can be considered to be the full-surface charging of the photoconductor to a uniform and usually quite high DC voltage, as the photoconductor moves past a charging station such as a charge corona. The charged photoconductor surface is then moved through an imaging station.

In a copier, the imaging station usually comprises an optical system that operates to reflect light off of an original document to be copied. As a result of the reflected light received from the document's white or lightly colored background area, the photoconductor retains a charge only in the area that corresponds to the document's darker or less reflective image area. This latent image is then toned, i.e. covered with toner, as the photoconductor passes through a developing station. Since toner is applied to the charged latent image in a copier, the process is called a charged area development (CAD) process.

In a printer, the imaging station usually comprises a printhead that is driven by binary print data that is supplied by a computer of some type. Laser printheads and LED printheads are two such well known imaging stations. Printers usually operate to discharge the photoconductor in the pattern of the image to be printed, i.e. the printhead usually writes the image to be printed, and as a result the latent image comprises discharged areas of the photoconductor. However, printers can also be configured to write the background, in which case the latent image comprises a charged photoconductor area. In any event, this latent image is then toned, i.e. covered with toner, as the photoconductor passes through a developing station. When toner is applied to the discharged latent image in a printer, the process is called a discharged area development (DAD) process. When toner is applied to the charged latent image in a printer, the process is again called a CAD process.

As will be apparent, the present invention finds utility in either a printer or a copier, and in either a CAD or a DAD process. An embodiment of the invention to be described is that of a DAD printer.

The usual next step of either a copier or a printer process is to transfer a major portion of the toner image that is carried by the photoconductor downstream of the developer station to transfer material, preferably to dielectric transfer material such as paper.

Two types of transfer material may be provided, one being discrete sheets of paper or paper-like material, and the other being a continuous web of paper. The present invention finds utility when individual sheet material is used.

Sheet transfer material is supplied to a transfer station where the paper moves in actual contact, or close proximity to, the photoconductor, so as to in effect cover the photoconductor and its toner image. As one side of the paper is in this close proximity to the photoconductor, the other side of the paper is subjected to the action of a toner transfer station. Two well known transfer stations are roll transfer and corona transfer. In either event, an electrical charge is applied to said other side of the paper, so as to attract toner from the photoconductor to said one side of the paper.

Thereafter, the paper is separated from the photoconductor and is transported to a fusing station whereat the toner is fused to said one side of the paper. The photoconductor is usually discharged and cleaned of residual toner, in preparation for reuse in the reproduction process.

In such a paper sheet device, the individual sheets that are fed to the transfer station are spaced from each other, such that for a period of time no transfer material is intermediate the transfer station and the photoconductor.

The present invention operates to control the transfer station in a manner to produce the same electrical effect on the photoconductor both when a sheet of transfer material resides in the transfer station intermediate the photoconductor and the transfer station, and when no sheet of transfer material is intermediate the photoconductor and the transfer station.

For an unrelated purpose, and for a different end result, U.S. Pat. No. 4,693,593 provides a reproduction device wherein a sensitometric device measures the characteristics of a photoconductor on a test area thereof that intentionally is not an area of the photoconductor that is used for reproduction. In order that this test area be representative of the portion of the photoconductor used for reproduction, steps are taken to ensure that the test area is subjected to the same charge/discharge history as is the portion of the photoconductor that is used in reproduction.

As a feature of the invention the transfer station includes both a transfer corona and a photoconductor erase or quench lamp.

In this regard, U.S. Pat. No. 3,851,230 is of interest in that it discloses transfer means for applying voltage to one side of a transfer-printing sheet, and illumination means for throwing visible light rays onto the photosensitive surface after the transfer-printing sheet has been brought into pressing contact with the photosensitive surface.

SUMMARY OF THE INVENTION

The present invention relates to electrophotographic or xerographic reproduction devices, such as copiers or printers, having a transfer station whereat toner images are transferred from the surface of a moving photoconductor to the adjacent surface of moving sheets of transfer material, such as, for example, paper. In accordance with the invention, the transfer station is controlled in a manner to produce a similar electrical effect on the photoconductor both when a sheet of transfer material resides in the transfer station intermediate the photoconductor and the transfer station, and when no sheet of transfer material is intermediate the photoconductor and the transfer station. Additionally, the transfer station is controlled while the leading and trailing edges of the sheet are passing the transfer station so as to effect toner transfer without overcharging the photoconductor thus producing a similar electrical effect on photoconductor as when a sheet of transfer material completely covers the transfer station.

As a feature of the invention the transfer station includes an illumination means that operates through the paper to discharge the photoconductor in preparation for use of the photoconductor in another reproduction cycle. In accordance with the invention, this discharge means is also controlled in a manner to produce a similar electrical effect on the photoconductor when a sheet of transfer material resides in the transfer station intermediate the photoconductor and the illumination means, and when no sheet of transfer material is intermediate the photoconductor and the illumination means.

Without limitation thereto, the present invention finds special utility in a reproduction device having a small photoconductor, i.e. a photoconductor whose process size is smaller than the process size of sheets of transfer material, such that a portion of the photoconductor that was not covered by a sheet of paper as it passed the transfer area on one reproduction cycle will be used to hold a toner image on the next or subsequent reproduction cycles.

Also without limitation thereto, preferred embodiments of the invention utilize a laser scanning imaging station, and a light emitting diode (LED) erasing station that is located at the transfer station.

It is an object of the invention to provide in an electrophotographic reproduction device having a transfer station that is spaced from a moving photoconductor, at which transfer station a toner image is transferred from the surface of the photoconductor to the adjacent surface of a sheet of moving transfer material that is in a position intermediate the transfer station and the photoconductor, a method and an apparatus for controlling the transfer station in a first manner to produce the transfer of toner from the photoconductor to a surface of the transfer material so long as a sheet is in a position intermediate the photoconductor and the transfer station and for controlling the transfer station in a second manner so long as a sheet is not in a position intermediate the photoconductor and the transfer station, the transfer station in the second manner of control being effective to produce a similar electrical effect on the photoconductor. The control of the transfer station is effected in a manner to insure transfer of toner from the leading edge to the trailing edge of the sheet.

The present invention is advantageously employed in reproduction devices in which transfer is provided for the full length of the transfer material (in the process direction) so that reproduction images can be transferred to the transfer material from the leading edge to the trailing edge of a sheet of transfer material.

As a feature of the invention the photoconductor is reused to sequentially carry a plurality of toner images to the transfer station, a like plurality of spaced sheets are fed to the transfer station in synchronism with the arrival of the plurality of toner images at the transfer station, and the transfer station is sequentially controlled in the above mentioned first and second manner as the plurality of sheets are fed to the transfer station.

In a preferred embodiment of the invention, the moving photoconductor is electrically charged prior to passing to an imaging station whereat the charged photoconductor is selectively discharged to form a latent image thereon. The photoconductor then moves to a development station whereat toner is applied to the latent image. The transfer station may include illumination means capable of emitting discharging illumination to which the photoconductor is sensitive, and when such an illumination means is provided it is controlled to produce a similar discharging effect on the photoconductor both when a sheet of transfer material is in a position intermediate the photoconductor and the transfer station, and when no sheet of transfer material is intermediate the photoconductor and the transfer station.

These and other objects and advantages of the invention will be apparent to those of skill in the art upon reference to the following detailed enabling description of preferred embodiments thereof, which description makes reference to the drawing.

DETAILED DESCRIPTION OF THE INVENTION

Figure 1:
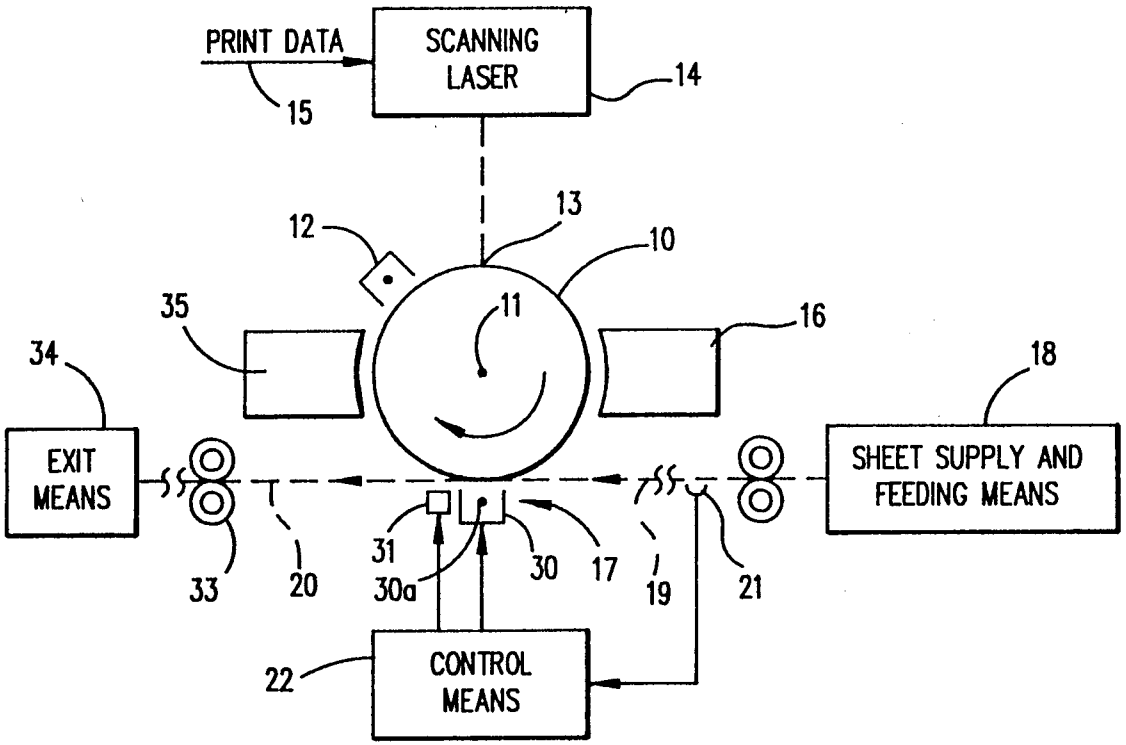
FIG. 1 shows a first embodiment of the invention wherein the reproduction device is in the form of a laser printer having a small size drum photoconductor, i.e. a drum whose circumferential length is small in relation to the process size of sheets of transfer material.

FIG. 1 shows a preferred embodiment of the invention, i.e. a DAD reproduction device in which the photoconductor is of a small process size in relation to the process size of the sheets of transfer material. A small desk top printer is an example of such a device. The spirit and scope of the invention is not to be limited, however, to such a small process size photoconductor. For example, the invention also finds utility in a demand type reproduction device where no particular area of a long photoconductor is dedicated to imaging use and no particular area of the photoconductor is dedicated to interimage use.

While it is within the spirit and scope of the invention to process sheets of transfer material of various lengths, including envelopes, the following explanation will assume, for simplicity of explanation, that sheets of 8.5×11 inch paper move through the reproduction process with a short 8.5 inch edge as a leading edge, and with the two 11 inch edges extending in a direction that is parallel to the process direction. Thus the process size of a sheet of transfer material is 11 inches.

In the reproduction device of FIG. 1 drum photoconductor 10, which within the scope and spirit of the invention could be a belt photoconductor if desired, rotates CW about axis 11 at a substantially constant speed during reproduction cycles. An exemplary surface or process speed of drum 10 is about 2 inches per second. By way of example, drum 10 may have a circumferential length of about 5 inches. Thus, a little over two revolutions of drum 10 are required for the processing of one sheet of 11 inch long paper.

In sequence, and as is well known by those of skill in the art, the photosensitive surface of the drum 10 is first charged to a relatively high DC voltage as incremental areas of the photoconductor move through or past a charging station that is defined by the charge corona 12. The charged photoconductor areas next pass through an imaging station 13. In this preferred embodiment, but without limitation thereto, imaging station 13 comprises a printhead of a scanning laser means 14 of the well known type. Scanning laser means 14 receives data to be printed by way of a print data line or bus 15.

As a result of the operation of the imaging station 13, an electrostatic latent image resides on the photoconductor drum 10 downstream of the imaging station 13. This electrostatic image then passes through or adjacent to the developer station 16 whereat toner is applied to the latent image. As stated, this preferred embodiment is a DAD device, thus discharged areas are toned.

As the now toned image on the surface of the drum 10 moves toward the transfer station 17, a sheet of paper is fed from the sheet supply and feeding means 18, for example at the same speed of about 2 inches per second, i.e. the same speed as the process speed of the drum 10. The details of construction and arrangement of the sheet supply and feeding means 18 is not critical to this invention, and in fact can take many forms as is well known to those skilled in the art. In addition, it is within the scope of the invention to control the beginning of laser scan as a function of the feeding of a sheet from means 18, or alternatively to control means 18 as a function of the progress of the laser scanning process.

Sheets that move through or into the reproduction process at about 2 inches per second follow a generally straight path having a first portion 19 that is upstream of the transfer station 17, and a second portion 20 that is down stream of the transfer station 17. In this embodiment of the invention, but without limitation thereto, the portion 19 of the sheet's process path 19,20 includes a sheet sensor means 21 that provides a signal indicative of the position of the sheet. For example, sensor 21 becoming active indicates that the leading 8.5 inch edge of a sheet has just arrived at the sensor, and the subsequent inactive signal from the sensor 21 indicates that the sheet's trailing 8.5 inch edge has just passed the location of sensor 21.

The signal from the sensor 21 can be used for a variety of operations, for example to begin the operation of the scanning laser 14. In the embodiment of FIG. 1, this signal from the sensor 21 is used as a control input to a control means 22 that operates to control the transfer station 17 so as to produce a similar electrical effect on the photosensitive surface of the photoconductor drum 10, independent of the presence or absence of a sheet of paper intermediate transfer station 17 and the adjacent surface of drum 10.

In this exemplary preferred embodiment, when consecutive reproductions or printed sheets are being produced, sheets are sequentially fed from means 18 with about a 1 inch spacing between the trailing 8.5 inch edge of one sheet and the leading 8.5 inch edge of the next sheet. As a result, a 1 inch axial band of the drum 10 will not be covered by a sheet as sequential prints are produced. This band is sometimes called an interimage area, i.e. an area that is intermediate two consecutive image areas. Since this 1 inch band of photoconductor will be used on the next revolution of the drum 10 to carry a latent/toner image, we have found that it is necessary that this band of photoconductor experience a similar electrical effect from the transfer station 17 as did the adjacent areas that carried the trailing end of one latent/toner image and the leading end of the next latent/toner image. Without the method and apparatus in accordance with the present invention, print quality will likely suffer.

While the invention is not to be limited thereby, it is believed that failure to produce a similar electrical effect on all areas of the photoconductor that will be subsequently used to contain a latent/toner image leads to non-uniform charging of the photoconductor at the charging station 12. In a typical printing operation, the drum 10 may be charged to a negative 900 volts at the charging station and discharged to a negative 200 volts by the combined action of the laser 14, transfer corona 30 and erase lamps 31. These voltages are all referenced to machine ground when the conductive core of the photoconductor drum 10 is at a potential of negative 100 volts.

In this preferred embodiment, the transfer station 17 comprises a transfer corona 30 and an erase or quench lamp 31. The transfer corona 30 operates to provide a charge on the bottom side of a sheet of transfer material as the sheet moves through the transfer station 17 at a speed of about 2 inches per second. As a result, a major portion of the photoconductor's toner image transfers to the upper surface of this sheet.

In accomplishing this toner transfer function, the transfer corona 30 also provides an electrical effect on the photosensitive surface of drum 10. This electrical effect is attenuated, or minimized, as a result of the sheet that exists intermediate the transfer station and the drum 10. However, when no sheet exists between the transfer corona 30 and the drum 10, a positive charge effected by the transfer corona 30 on the drum 10 causes the drum 10 to assume a positive voltage of +300 to +400 volts. This positive voltage charge cannot be discharged by the effect of the light produced by the erase means 31 as it functions only to discharge negative charge on the drum 10. Thus, the transfer corona must be turned off when no sheet is adjacent thereto. However, as the leading edge of the sheet starts its movement past the transfer corona 30, it is necessary to turn the transfer corona 30 on in order to effect toner transfer to the leading edge area. In a similar vein, as the trailing edge of the sheet leaves the transfer corona, the transfer corona must remain on in order to effect toner transfer over the trailing edge of the sheet. When the transfer corona is thusly turned on during the leading and trailing edge portion, an undesirable excessively positive charge is placed on the drum 10. Thus, during these two transitional periods, the control means 22 reduces the energization of the transfer corona so that toner transfer is still effected and so that the drum 10 is not overly charged.

The control means 22 reduces energization by changing or modulating the current to the corona wire **30*a*. It has been found that by switching the current at the modulation rate of 40 milliseconds, i.e. 20 milliseconds on and 20 milliseconds off, that the full current of 112 microamperes can be reduced by one-half to 56 microamperes. If a modulation interval exceeding 50 milliseconds is utilized, undesirable striping effects result in subsequent images. Once the sheet has passed the transfer corona 30, current to the corona wire 30*a* is terminated and reliance is made upon the erase means 31 to effect discharge of the drum 10** to the proper voltage levels.

The control means 22 functions to control the erase means 31 in a manner similar to the control effected for the transfer corona 30. That is, lamps located within the erase means 31 are turned on to their maximum power setting when a sheet is located intermediate the erase means 31 and the drum 10. When a sheet is not so located therebetween, the control means 22 reduces the illumination by two-thirds. This power reduction is accomplished by modulating the current to the erase means at 10 milliseconds on and 20 milliseconds off. In this manner, the combined effect of the transfer corona 30*a* acting through the sheet and the erase means 31 being on full when a sheet is located between the transfer station 17 and the drum 10, results in a drum charge of approximately −200 volts. Further, when a sheet is absent and the transfer corona is turned off and the erase means 31 is at a reduced power level, the resultant charge on the drum 10 is approximately −200 volts. When the transfer corona 30 operates at partial power and when the illumination means operates at full power during the leading and trailing edge intervals, the resultant charge on the drum 10 is approximately −180 volts. As a result, the charge corona 12 is able to uniformly charge the photoconductor drum 10 to approximately −900 volts prior to its next imaging cycle.

The details of construction of the control means 22 can take many forms, as may be desired by those of skill in the art. Whatever form the control means 22 takes, control of this means in accordance with the invention produces a similar electrical effect on the photoconductor drum independent of the presence or absence of a sheet of transfer material in the transfer station 17.

It is to be understood that when the reproduction device is in a standby mode of operation, awaiting use, the transfer corona 30 and the erase means 31 are preferably totally inactive, i.e. total deenergization.

Upon initial turn on of the device, it may be desirable to initialize the photoconductor in any of the ways well known in the art, and this may include partial or full energization of the transfer station 17. It has been found that energization of the erase means 31 for a complete rotation of the drum 10 prior to the arrival of the image area, results in a uniform charge on the drum for imaging purposes. Thus, the control means 22 is activated to turn the erase means on to partial power for one drum revolution prior to imaging.

After toner is transferred to the top surface of a sheet of transfer material, the sheet enters the portion 20 of the sheet's process path. In this portion of the path, the toner image is fused to the surface of the sheet, for example, by operation of the fuser station 33. The sheet then exits to the exit means 34 which may be a conventional stacking apparatus. The cleaning station 35 removes residual toner from the drum 10 prior to charging the drum 10 at the charge corona 12.

Figure 2:
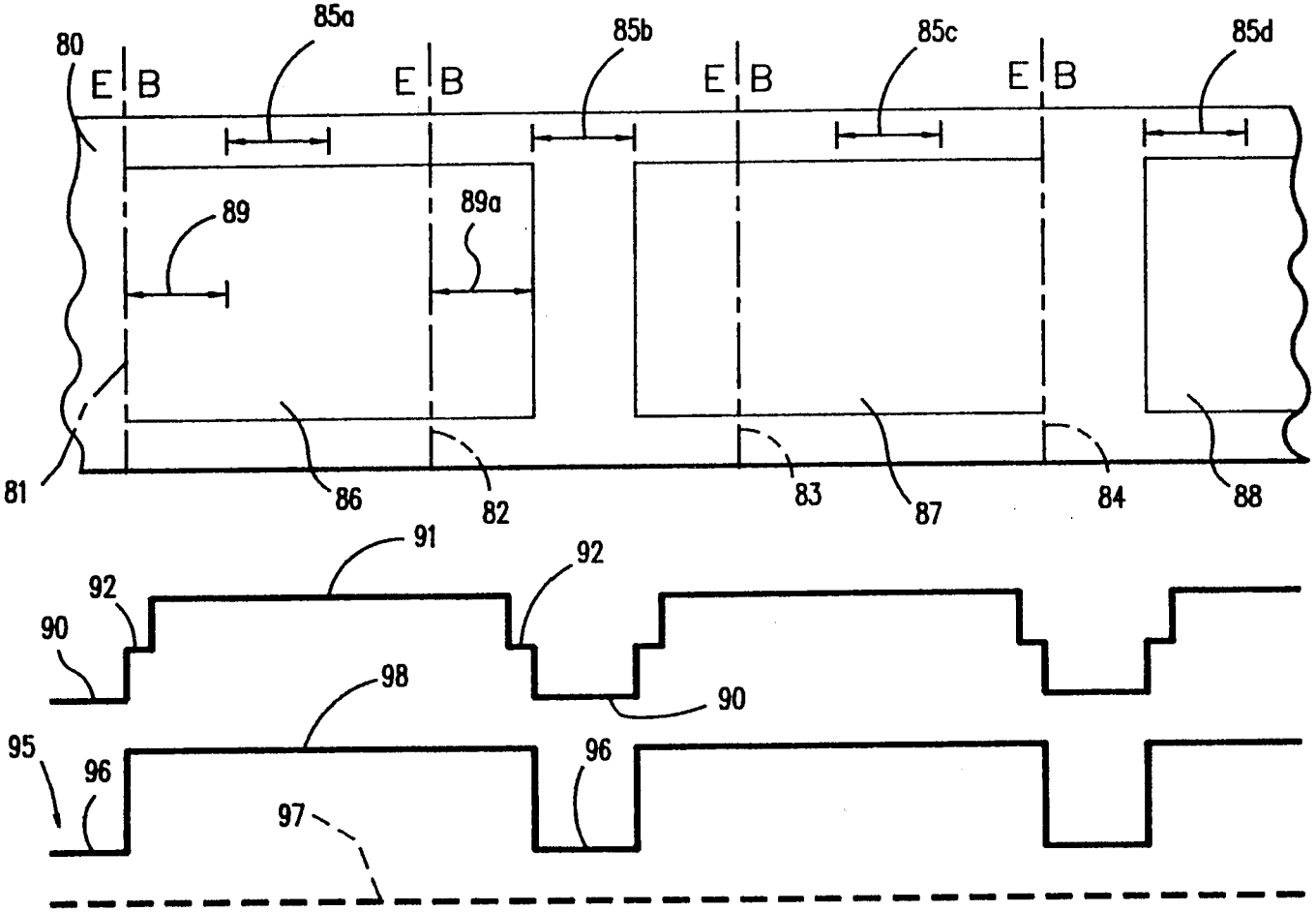
FIG. 2 shows another embodiment of the invention wherein a small photoconductor is shown in an unrolled and repeating state relative to two sequentially fed sheets of transfer material, and FIGS. 3A and 3B an embodiment of the invention in flow chart form.

As stated previously, the present invention finds utility with any of the well known types of xerographic reproduction devices. FIG. 2 presents a generic reproduction device, such as a device having a small process size photoconductor. By definition, a small process size photoconductor is a photoconductor whose continuous surface is not long enough to carry a single toner image to be transferred to the sheet of transfer material. As a result, a portion of the photoconductor that carried the beginning of a given toner image must be reused to carry the ending portion of the same toner image.

In this figure, reference number 80 shows the photoconductor in an unrolled state, and repeated to show a number of repetitions or cycles of use thereof. Construction Lines 81–84 show an imaginary line that divides the beginning of the photoconductor from the end of the photoconductor. This is designated in FIG. 2 by the letters "B" and "E". A generally middle area of the photoconductor 85*a* through 85*d* is shown, as the photoconductor repetitively moves through the reproduction process four times.

In this exemplary device, sheets of image transfer paper move through the process with a long edge extending in the process direction. For simplicity of explanation, the paper will be regarded as being eight units in length (in the process direction). Three successive sheets of paper 86–88 are shown in FIG. 2.

In this exemplary device, the photoconductor is of a small process size, and thus, one cycle of the photoconductor does not carry the complete toner image for an eight unit long sheet of paper. In the present example, the photoconductor is six units in length (in the process direction) in its unrolled state. For the sheet 86 the portion 89 of the photoconductor is two units in length (in its unrolled state) and carries the leading portion of the image for sheet 86. This same portion 89*a* of the photoconductor is reused to carry the trailing portion of the image for this same sheet 86.

The next two unit portion of the sheet 86 is carried by a portion 85*a* of the photoconductor. This portion 85*a* of the photoconductor is two units in length.

The engineering tolerances and the like of an exemplary reproduction device require that there be a spacing between the trailing edge of a sheet and the leading edge of the next sheet. This corresponds to an "uncovered" area of the photoconductor, i.e., during this time the transfer station directly faces the photoconductor, with no intervention sheet of transfer material. This area is often called the photoconductor's interimage area. For simplicity of illustration, the interimage areas of FIG. 2 are shown as two units in length in the process direction.

The interimage area 85*b* between sheets 86 and 87 comprises the first repetition of the above mentioned photoconductor area 85*a*. Note that for sheet 86, this area 85*a* of the photoconductor carried a portion of the toner image for sheet 86. The first repetition of this same area 85*b* comprises the interimage area between sheets 86 and 87, the second repetition of this area 85*c* comprises a portion of the toner image for sheet 87, and the third repetition of this area 85*d* comprises a portion of the toner image for sheet 88. Thus, it can be seen that the interimage area of photoconductor 80 moves along the photoconductor as transfer material sequentially moves through the transfer station of the reproduction device.

An object of the present invention is to insure that all areas of the photoconductor are subjected to a similar electrical effect by the transfer station of the reproduction device, as the interimage area moves to different portions of the photoconductor in different reproduction cycles.

FIG. 2 also shows operation of the reproduction device's transfer station. The current reference line 90 of FIG. 2 indicates a condition in which the transfer corona is totally inactive. This condition of the transfer corona would be the condition, for example, when the reproduction device was in a ready, but inactive, state awaiting use. As illustrated, in accordance with the invention, the transfer station is active at its highest level 91 only when the photoconductor is "covered" by sheets 86, 87 and 88.

In accordance with the invention, the transfer corona is rendered less active, but not totally inactive, for each transition area to the interimage gaps between sheets of transfer material, this being shown by level 92. Further, when there is no sheet between the transfer corona and the photoconductor, corona current is turned off as indicated by level 90.

The current waveform 95 represents the current to the erase lamp. During initialization prior to printing the first sheet 86, the lamp is brought to an intermediate current level 96 from its off or zero level 97. As the first sheet 86 moves therepast, full power as indicated by level 98 is applied to the lamp. Thereafter, the lamp is brought to its one-third current level 96 whenever an interimage is adjacent thereto. The lamp is returned to its zero level 97 when the reproduction cycles have been completed.

Figure 3A:
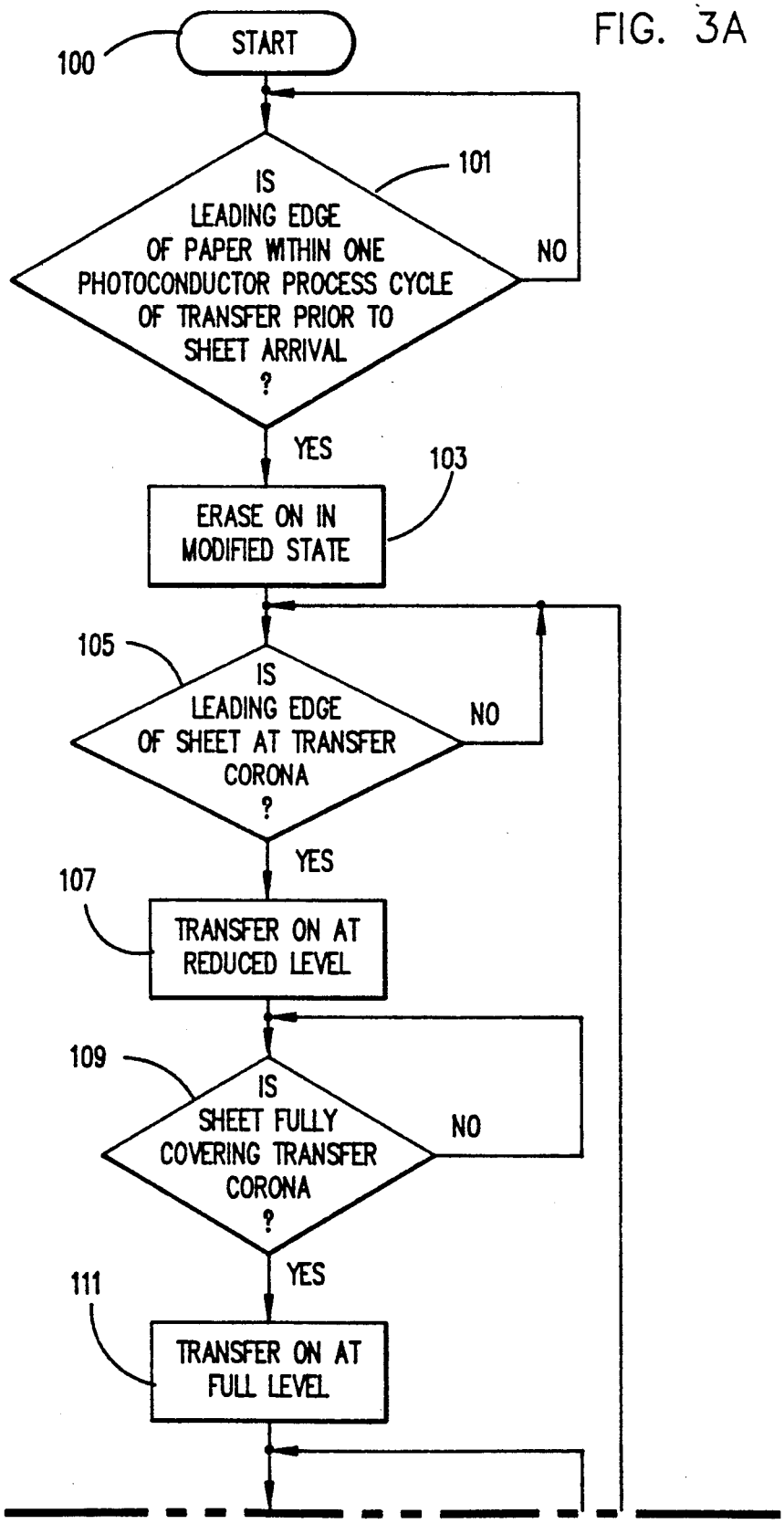
Figure 3B:
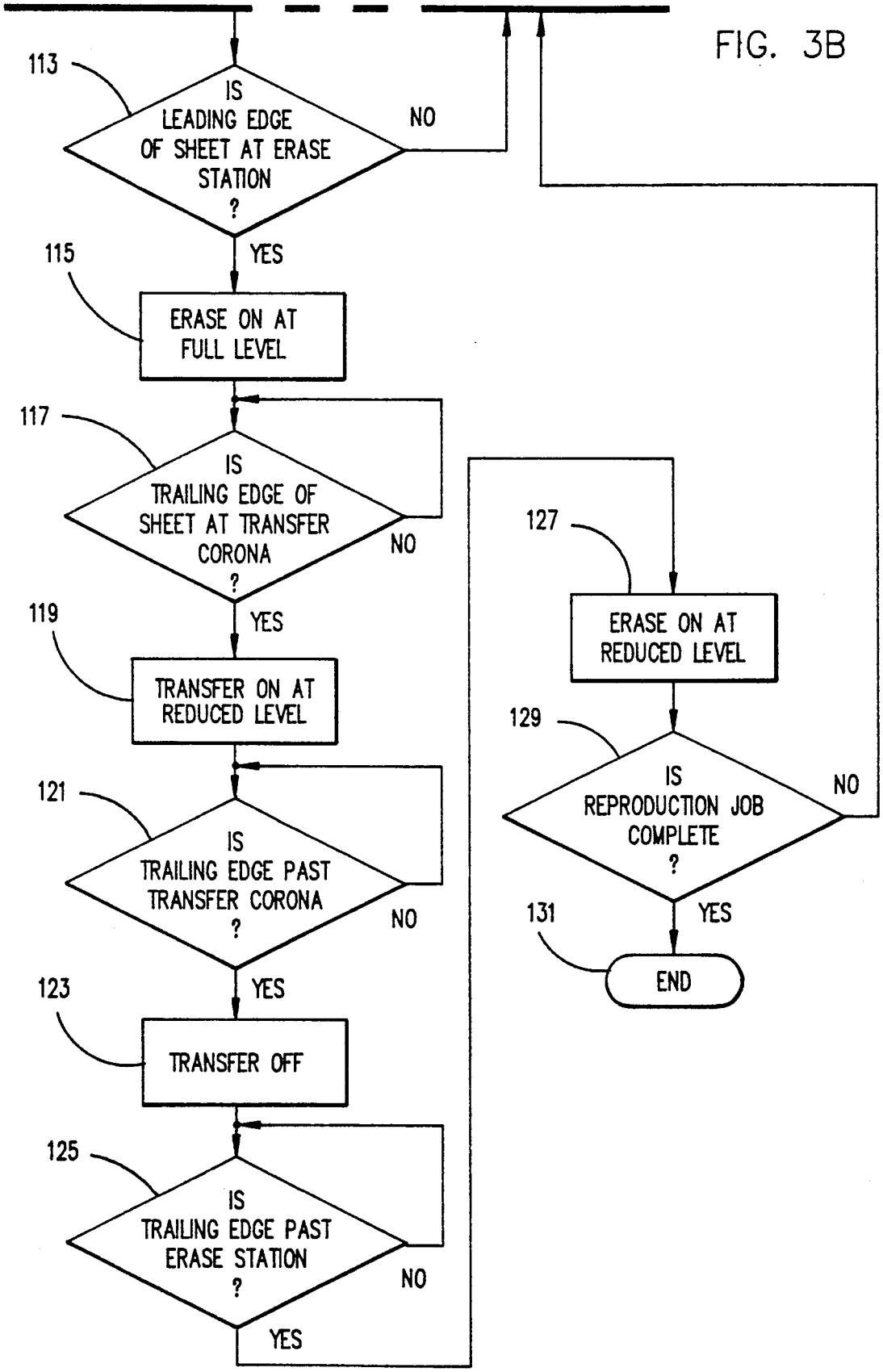

FIGS. 3A and 3B show a construction arrangement of the invention in flowchart form. It describes the logic effected by the control means 22 of FIG. 1 to control the operation of the transfer station 17.

The beginning of the invention process is indicated by the event 100. Thereafter, the process awaits the arrival of the leading edge of the first sheet at a location within one photoconductor process cycle of the transfer station prior to sheet arrival as indicated by block 101. When this event occurs, erase lamps are turned on to their low level state as indicated by block 103 in order to condition the photoconductor which will receive the image to be transferred to the sheet. Thereafter, as indicated by block 105, the process awaits the arrival of the leading edge of the sheet at the transfer corona. When it arrives, the transfer corona is turned on at a reduced level as indicated by block 107. When the sheet fully covers the transfer corona, as indicated by block 109, the transfer current is turned on to its full level as indicated by block 111. When the leading edge of the sheet arrives at the erase station as indicated by block 113, the current to the erase lamps is turned on at a full level as indicated by block 115. Thereafter, the process awaits the arrival of the trailing edge of the sheet at the transfer corona as indicated by block 117. When this occurs the current to the transfer corona is reduced as indicated by block 119 until the trailing edge has passed the transfer corona as indicated by block 121. At this time, the transfer corona is turned off as indicated by block 123. Thereafter, the process awaits the arrival of the trailing edge of the sheet at the erase station as indicated by block 125 at which time the erase lamps are turned on at a reduced level as indicated by block 127. If successive sheets are being printed as indicated by block 129, the process continues to block 105 to await the arrival of the next sheet at the transfer corona. If, however, the reproduction job is complete, the process is terminated as indicated by block 131. Termination includes the process of turning off the erase lamps as the photoconductor motion is halted.

While the present invention has been described in detail with reference to preferred embodiments thereof, it is apparent that those of skill in the art will readily visualize other embodiments within the scope and spirit of the invention. For example, the control means has been described as providing a stepped current control to the transfer corona during the passage of the leading and trailing edges of sheets. This control could be ramped to provide more tightly limited voltage variations on the photoconductor. Thus the present invention is to be limited only by the following claims.

We claim:

1. In an electrophotographic reproduction device having an imaging station, a developer station, and a transfer station including transfer corona means and illumination means that is spaced from a moving photoconductor, at which transfer station a toner image is transferred from the surface of said photoconductor to the adjacent surface of a sheet of moving transfer material that is in a position intermediate said transfer station and said photoconductor, a method for controlling said transfer station, comprising; electrically charging said moving photoconductor prior to passing to the imaging station, selectively discharging the photoconductor at the imaging station to form a latent image thereon, applying toner to said latent image on the photoconductor at the developer station, providing a supply of transfer sheets, feeding sheets from said supply of sheets to said transfer station, one sheet at a time, and in synchronism with the arrival of a toner image at said transfer station, determining the position of said fed sheet of transfer material as the fed sheet moves from said supply of sheets toward said transfer station, controlling said transfer station in a first manner to produce the transfer of toner from said photoconductor to a surface of said transfer material so long as a fed sheet is in a position intermediate said photoconductor and said transfer station, said transfer station in said first manner of control being effective to provide a first level of energization of said transfer corona means to produce an electrical effect on said photoconductor, controlling said transfer station in a second manner so long as a fed sheet is not in a position intermediate said photoconductor and said transfer station, said transfer station in said second manner of control being effective to provide a second level, lower than said first level, of energization of said transfer corona means to produce said electrical effect on said photoconductor, to thereby produce a substantially similar electrical effect on said photoconductor both when a sheet of transfer material is in a position intermediate the photoconductor and the transfer station, and when no sheet of transfer material is intermediate the photoconductor and the transfer station, emitting discharging illumination to which said photoconductor is sensitive from the illumination means at the transfer station, controlling said illumination means to produce a substantially similar discharging effect on said photoconductor both when a sheet of transfer material is in a position intermediate the photoconductor and the transfer station, and when no sheet of transfer material is intermediate the photoconductor and the transfer station, reusing said photoconductor to sequentially carry a plurality of toner images to said transfer station, feeding a like plurality of sheets from said supply of sheets to said transfer station, one sheet at a time, and in synchronism with the arrival of said plurality of toner images at said transfer station, and sequentially controlling said transfer station in said first and said second manner as said plurality of sheets are fed to said transfer station.

2. Electrophotographic reproduction apparatus, comprising, stationary transfer station means, a substantially continuous and reusable moving photoconductor that moves in a cycle that includes a position at which a portion of said photoconductor is closely adjacent to but spaced from said transfer station means, a supply of transfer sheets, means for feeding a sheet from said supply of sheets to said transfer station means in synchronism with the arrival of a toner image at said transfer station means, such that a toner image on said photoconductor is transferred from the surface of said photoconductor to the adjacent surface of a s sheet of moving transfer material as said sheet is in a position intermediate said transfer station means and said photoconductor, control means for controlling said transfer station means in a first manner to produce the transfer of toner from said photoconductor to said transfer material so long as a fed sheet is in a position intermediate said photoconductor and said transfer station means, and for controlling said transfer station means in a second manner so long as a fed sheet is not in a position intermediate said photoconductor and said transfer station means, to thereby produce a substantially similar electrical effect on said photoconductor both when a sheet of transfer material is in a position intermediate the photoconductor and said transfer station means, and when no sheet of transfer material is intermediate the photoconductor and said transfer station means, wherein said control means is responsive to the position of said fed sheet of transfer material as the fed sheet moves from said supply of sheets toward said transfer station means, wherein said photoconductor is reused to sequentially carry a plurality of toner images to said transfer station, wherein a like plurality of sheets are fed from said supply of sheets to said transfer station means, one sheet at time, and in synchronism with the arrival of said plurality of toner images at said transfer station means, wherein said transfer station means is sequentially controlled in said first and said second manner as said plurality of sheets are fed to said transfer station means, wherein said transfer station means includes transfer corona means and wherein said first manner of controlling said transfer station means provides a higher level of energization of said transfer corona means than does said second manner of control thereof, and including:

charging station means for charging said moving photoconductor, imaging station means whereat said charged photoconductor is subsequently selectively discharged to form a latent image thereon, developer station means whereat toner is subsequently applied to said latent image, and said transfer station means including illumination means capable of emitting illumination to which said photoconductor is sensitive, wherein said illumination means is controlled to produce a substantially similar effect on said photoconductor both when a sheet of transfer material is in a position intermediate the photoconductor and the transfer station means, and when no sheet of transfer material is intermediate the photoconductor and the transfer station means.

3. The apparatus of claim 2 wherein said reproduction device is a printer having an imaging station in the from of a printhead.

4. Electrophotographic reproduction apparatus, comprising:

a supply of transfer sheets, means for feeding a sheet from said supply of sheets, aid sheet having a process size as measured in the direction of sheet feeding, transfer station means located downstream of said supply of transfer sheets, a substantially continuous and reusable moving photoreceptor that moves in a process cycle that includes a position at which sequential incremental portions of said photoreceptor are closely adjacent to but spaced from said transfer station means, said photoreceptor having a process size as measured in the direction of its movement that is less than the process size of said sheet, means for synchronizing the feeding of a sheet from said supply and the arrival of said incremental portions of said photoreceptor at said transfer station means, such that an image on said photoreceptor is transferred from the surface of said incremental portions of said photoreceptor to the adjacent surface of a sheet as said sheet is in a position intermediate said transfer station means and said photoreceptor, control means for controlling said transfer station means in a first manner to produce the transfer of an image from said photoreceptor to a sheet so long as a sheet is in a position intermediate said photoreceptor and said transfer station, and for controlling said transfer station means in a second manner so long as a sheet is not in a position intermediate said photoreceptor and said transfer station, to thereby produce a substantially similar electrical effect on said photoreceptor both when a sheet is in a position intermediate the photoreceptor and said transfer station means, and when no sheet is intermediate the photoreceptor and said transfer station means, charging station means for charging said moving photoreceptor, imaging station means whereat said charged photoreceptor is subsequently and selectively discharged to form an electrostatic latent image thereon, developer station means whereat toner is subsequently applied to said latent image, said transfer station means including illumination means capable of emitting charge erasing illumination toward said photoreceptor, both when a sheet is in a position intermediate said photoreceptor and said illumination means, and when no sheet is intermediate said photoreceptor and said illumination means, and wherein said illumination means is controlled to produce a substantially similar charge erasing effect on aid photoreceptor both when a sheet is in a position intermediate said photoreceptor and said transfer station means, and when no sheet is intermediate said photoreceptor and said transfer station means.

5. The apparatus of claim 4 wherein said reproduction device is a printer having an imaging station in the from of a printhead.

6. Electrophotographic reproduction apparatus, comprising, a supply of transfer sheets, means for feeding a sheet from said supply of sheets, aid sheet having a process size as measured in the direction of sheet feeding, transfer station means located downstream of said supply of transfer sheets, a substantially continuous and reusable moving photoreceptor that moves in a process cycle that includes a position at which sequential incremental portions of said photoreceptor are closely adjacent to but spaced from said transfer station means, said photoreceptor having a process size as measured in the direction of its movement that is less than the process size of said sheet, means for synchronizing the feeding of a sheet from said supply and the arrival of said incremental portions of said photoreceptor at said transfer station means, such that an image on said photoreceptor is transferred from the surface of said incremental portions of said photoreceptor to the adjacent surface of a sheet as said sheet is in a position intermediate said transfer station means and said photoreceptor, control means for controlling said transfer station means in a first manner to produce the transfer of an image from said photoreceptor to a sheet so long as a sheet is in a position intermediate said photoreceptor and said transfer station, and for controlling said transfer station means in a second manner so long as a sheet is not in a position intermediate said photoreceptor and said transfer station, to thereby produce a substantially similar electrical effect on said photoreceptor both when a sheet is in a position intermediate the photoreceptor and said transfer station means, and when no sheet is intermediate the photoreceptor and said transfer station means, charging station means for charging said moving photoreceptor, laser scanning imaging station means whereat said charged photoreceptor is selectively discharged to form an electrostatic latent image thereon, developer station means whereat toner is applied to said latent image, said transfer station means including erase means for discharging said photoreceptor both when a sheet is in a position intermediate said photoreceptor and said erase means, and when no sheet is intermediate said photoreceptor and said erase means, and wherein said erase means is controlled to produce a substantially similar discharging effect on said photoreceptor both when a sheet is in a position intermediate said photoreceptor and said erase means, and when no sheet is intermediate said photoreceptor and said erase means.

7. The apparatus of claim 6 wherein said control means includes means for determining the position of a sheet as said sheet moves from said supply toward said transfer station means.

8. The apparatus of claim 7 wherein said photoreceptor is reused to sequentially carry a plurality of toner images to said transfer station means, wherein a like plurality of sheets are fed from said supply of sheets to said transfer station means, one sheet at a time, and in synchronism with the arrival of said plurality of toner images at said transfer station means, and wherein said transfer station means and said erase means are sequentially controlled in said first and said second manner as said plurality of sheets are fed to said transfer station means.

9. In a xerographic reproduction device having an electrically energizable transfer corona operating to sequentially transfer a toner image from a photoconductor to sheets of paper as said corona is energized at a first level of energization, the sheets being fed through a space that exists between said photoconductor and said transfer corona, said sheets having a finite spacing between adjacent sheets, such that for periods of time no paper exists in said space between said transfer corona and said photoconductor, the improvement comprising, providing a finite level of energization to said transfer corona means that is lower than said first level of energization, when a sheet does not exist in said space between said transfer corona and said photoconductor, to thereby subject all portions of said photoconductor to a substantially similar transfer corona effect, such that upon subsequent recycling of said photoconductor, sand use of a previously uncovered portion thereof to contain a toner image, the quality of said subsequent toner image is not adversely effected, electrically energizable photoconductor illumination means located adjacent said transfer corona so as to illuminate said photoconductor through a sheet when a sheet exists in said space between said transfer corona and said photoconductor, and means providing a first level of energization to said illumination means when a sheet exists in said space between said transfer corona and said photoconductor, and providing a finite level of energization that is less than said first level of energization when a sheet does not exist in said space between said transfer corona and said photoconductor.

to thereby subject all portions of said photoconductor to a substantially similar illumination effect, such that upon subsequent recycling of said photoconductor, and use of a previously uncovered portion thereof to contain a toner image, the quality of said subsequent toner image is not adversely effected.

10. Electrophotographic reproduction apparatus, comprising, stationary transfer station means, a substantially continuous and reusable moving photoconductor that moves in a cycle that includes a position at which a portion of said photoconductor is closely adjacent to but spaced from said transfer station means, a supply of transfer sheets, means for feeding a sheet from said supply of sheets to said transfer station means in synchronism with the arrival of a toner image at said transfer station means, such that a toner image on said photoconductor is transferred from the surface of said photoconductor to the adjacent surface of a sheet of moving transfer material as said sheet is in a position intermediate said transfer station means and said photoconductor, and said transfer station means including illumination means capable of emitting illumination to which said photoconductor is sensitive, wherein said illumination means is controlled to produce a substantially similar effect on said photoconductor both when a sheet of transfer material is in a position intermediate the photoconductor and the transfer station means, and when no sheet of transfer material is intermediate the photoconductor and the transfer station means.

* * * * *

UNITED STATES PATENT AND TRADEMARK OFFICE

CERTIFICATE OF CORRECTION

PATENT NO. : 5,012,293

DATED : April 30, 1991

INVENTOR(S) : Charles S. Aldrich et al

It is certified that error appears in the above-identified patent and that said Letters Patent is hereby corrected as shown below:

Column 11, line 13 delete "s".
Column 12, line 6 delete "from" and insert --form--;
Column 12, line 62 delete "aid" and insert --said--;
Column 12, line 68 delete "from" and insert --form--.
Column 13, line 5 delete "aid" and insert --said--.

Signed and Sealed this

Tenth Day of November, 1992

*Attest:*

*Attesting Officer*

DOUGLAS B. COMER

*Acting Commissioner of Patents and Trademarks*